US007059068B2

(12) United States Patent
Magallanes et al.

(10) Patent No.: US 7,059,068 B2
(45) Date of Patent: Jun. 13, 2006

(54) HEIGHT ADJUSTABLE FLEXIBLE SHOE

(76) Inventors: Hilda Magallanes, 149 E. St. Andrews St., Ontario, CA (US) 91761; Jose Luis Chavez, 149 E. St., Andrews St., Ontario, CA (US) 91761

( * ) Notice: Subject to any disclaimer, the term of this patent is extended or adjusted under 35 U.S.C. 154(b) by 205 days.

(21) Appl. No.: 10/300,606

(22) Filed: Nov. 20, 2002

(65) Prior Publication Data

US 2003/0136028 A1 Jul. 24, 2003

Related U.S. Application Data

(63) Continuation-in-part of application No. 09/829,325, filed on Apr. 9, 2001, now abandoned.

(51) Int. Cl.
*A43B 3/24* (2006.01)
*A43B 21/36* (2006.01)
*A43B 21/437* (2006.01)

(52) U.S. Cl. ..... 36/100; 36/36 R; 36/36 A; 36/36 B; 36/42

(58) Field of Classification Search ..... 36/36 R, 36/36 A, 36 B, 36 C, 42, 103, 105, 100
See application file for complete search history.

(56) References Cited

U.S. PATENT DOCUMENTS 80,555 A * 1/1868 Martin ..... 36/36 R
980,085 A * 12/1910 Fenton ..... 36/36 R
1,439,600 A * 12/1922 Bonawitz ..... 36/36 R
1,479,421 A * 1/1924 Powell ..... 36/36 R
1,551,345 A * 8/1925 Thomasian ..... 36/36 R
2,767,489 A * 10/1956 Sturman ..... 36/42
2,934,840 A * 5/1960 Mistarz ..... 36/34 R
3,478,447 A * 11/1969 Gillead ..... 36/36 R
4,272,897 A * 6/1981 Ponce ..... 36/42
4,554,749 A * 11/1985 Ostrander ..... 36/103
4,610,100 A * 9/1986 Rhodes ..... 36/42
4,680,876 A * 7/1987 Peng ..... 36/34 R
5,133,138 A * 7/1992 Durcho ..... 36/36 R

* cited by examiner

*Primary Examiner*—Anthony D. Stashick
(74) *Attorney, Agent, or Firm*—Goldstein Law Offices, P.C.

(57) ABSTRACT

A height adjustable flexible shoe including a shoe upper portion having an open upper end, a closed lower end, and a body portion therebetween. The open upper end is dimensioned for receiving a foot therein. The closed lower end has a toe portion and a back portion. The back portion has a first heel portion extending downwardly therefrom. The body portion is comprised of an adjustable elastomeric material. A second heel portion is adapted for removably coupling with the first heel portion of the shoe upper portion. A third heel portion is adapted for removably coupling with the second heel portion. The first, second, and third heel portions are of substantially equal heights to provide significant control over the inclination of the shoe.

2 Claims, 2 Drawing Sheets

HEIGHT ADJUSTABLE FLEXIBLE SHOE

CROSS REFERENCES AND RELATED SUBJECT MATTER

This application is a continuation-in-part of U.S. patent application Ser. No. 09/829,325, filed in the United States Patent Office on Apr. 9, 2001 now abandoned.

BACKGROUND OF THE INVENTION

The present invention relates to a height adjustable flexible shoe and more particularly pertains to allowing a person to easily adjust a heel of a shoe to reach a proper height.

The use of footwear heel devices is known in the prior art. More specifically, footwear heel devices heretofore devised and utilized for adjusting heel sizes are known to consist basically of familiar, expected and obvious structural configurations, notwithstanding the myriad of designs encompassed by the crowded prior art that have been developed for the fulfillment of countless objectives and requirements.

By way of example, U.S. Pat. No. 6,021,586 to Bucalo discloses a shoe with an adjustable heel assembly for positioning at a number of heights. U.S. Pat. No. 2,707,341 to Romano discloses a shoe with convertible heels capable of extending or retracting and locking into position with a button assembly. U.S. Pat. No. 3,056,217 to Tholander discloses an attachable heel lift device comprised of a bore and dowel assembly. U.S. Pat. No. 4,610,100 to Rhodes discloses a device which uses a mortised heel to be selectively inserted between a shoe body and a wear pad.

While these devices fulfill their respective, particular objective and requirements, the aforementioned patents do not describe a height adjustable flexible shoe for allowing a person to easily adjust a heel of a shoe to reach a proper height.

In this respect, the height adjustable flexible shoe according to the present invention substantially departs from the conventional concepts and designs of the prior art, and in doing so provides an apparatus primarily developed for the purpose of allowing a person to easily adjust a heel of a shoe to reach a proper height.

Therefore, it can be appreciated that there exists a continuing need for a new and improved height adjustable flexible shoe that can be used for allowing a person to easily adjust a heel of a shoe to reach a proper height. In this regard, the present invention substantially fulfills this need.

SUMMARY OF THE INVENTION

In the view of the foregoing disadvantages inherent in the known types of footwear heel devices now present in the prior art, the present invention provides an improved height adjustable flexible shoe. As such, the general purpose of the present invention, which will be described subsequently in greater detail, is to provide a new and improved height adjustable flexible shoe that has all the advantages of the prior art and none of the disadvantages.

To attain this, the present invention essentially comprises a shoe upper portion having an open upper end, a closed lower end, and a body portion therebetween. The open upper end is dimensioned for receiving a foot therein. The closed lower end has a toe portion and a back portion. The back portion has a first heel portion extending downwardly therefrom. The first heel portion has a lower end with an aperture formed therein. The body portion comprises an adjustable elastomeric material. A second heel portion is adapted for removably coupling with the first heel portion of the shoe upper portion. The second heel portion has a wide upper end and a narrow lower end. The wide upper end has a protrusion extending upwardly therefrom. The protrusion is dimensioned for snap engaging the aperture in the lower end of the first heel portion of the shoe upper portion. The narrow lower end has an aperture formed therein. A third heel portion is adapted for removably coupling with the second heel portion. The third heel portion has a wide upper end and a narrow lower end. The wide upper end has a protrusion extending outwardly thereof. The protrusion is dimensioned for being selectively snap engaged with the aperture of the first heel portion and the second heel portion. The first, second, and third heel portions are of substantially equal heights to provide significant control over the inclination of the shoe.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved height adjustable flexible shoe that is capable of easily adjusting in height. Accordingly, the height adjustable shoe gives the user the option of using either one, both, or neither of a second and third heel portion to adjust the angle of inclination of the shoe.

It is another object of the present invention to provide a new and improved height adjustable flexible shoe is comfortable to wear, regardless of the selected height configuration. Accordingly, the shoe is elastic, so that it can easily adjust the user's foot position to accommodate the change in inclination accomplished by reconfiguring the heel.

It is a further object of the present invention to provide a new and improved height adjustable flexible shoe that is of durable and reliable construction.

An even further object of the present invention is to provide a new and improved height adjustable flexible shoe that is susceptible of a low cost of manufacture with regard to both materials and labor, and which accordingly is then susceptible of low prices of sale to the consuming public, thereby making such a height adjustable flexible shoe economically available to the buying public.

Even still another object of the present invention is to provide a new and improved height adjustable flexible shoe for allowing a person to easily adjust a heel of a shoe to reach a proper height.

Lastly, it is an object of the present invention to provide a new and improved height adjustable flexible shoe including a shoe upper portion having an open upper end, a closed lower end, and a body portion therebetween. The open upper end is dimensioned for receiving a foot therein. The closed lower end has a toe portion and a back portion. The back portion has a first heel portion extending downwardly therefrom. The body portion comprises an adjustable elastomeric material. A second heel portion is adapted for removably coupling with the first heel portion of the shoe upper portion. A third heel portion is adapted for removably coupling with the second heel portion. The first, second, and third heel portions are of substantially equal heights to provide significant control over the inclination of the shoe.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

With reference now to the drawings, and in particular, to figures one through two thereof, the preferred embodiment of the new and improved height adjustable flexible shoe embodying the principles and concepts of the present invention and generally designated by the reference number 10 will be described.

Specifically, it will be noted in the various figures that the device relates to a height adjustable flexible shoe for allowing a person to easily adjust a heel of a shoe to reach a proper height. In its broadest context, the device consists of a shoe upper portion, a second heel portion, and a third heel portion. Such components are individually configured and correlated with respect to each other so as to attain the desired objective.

Figure 1:
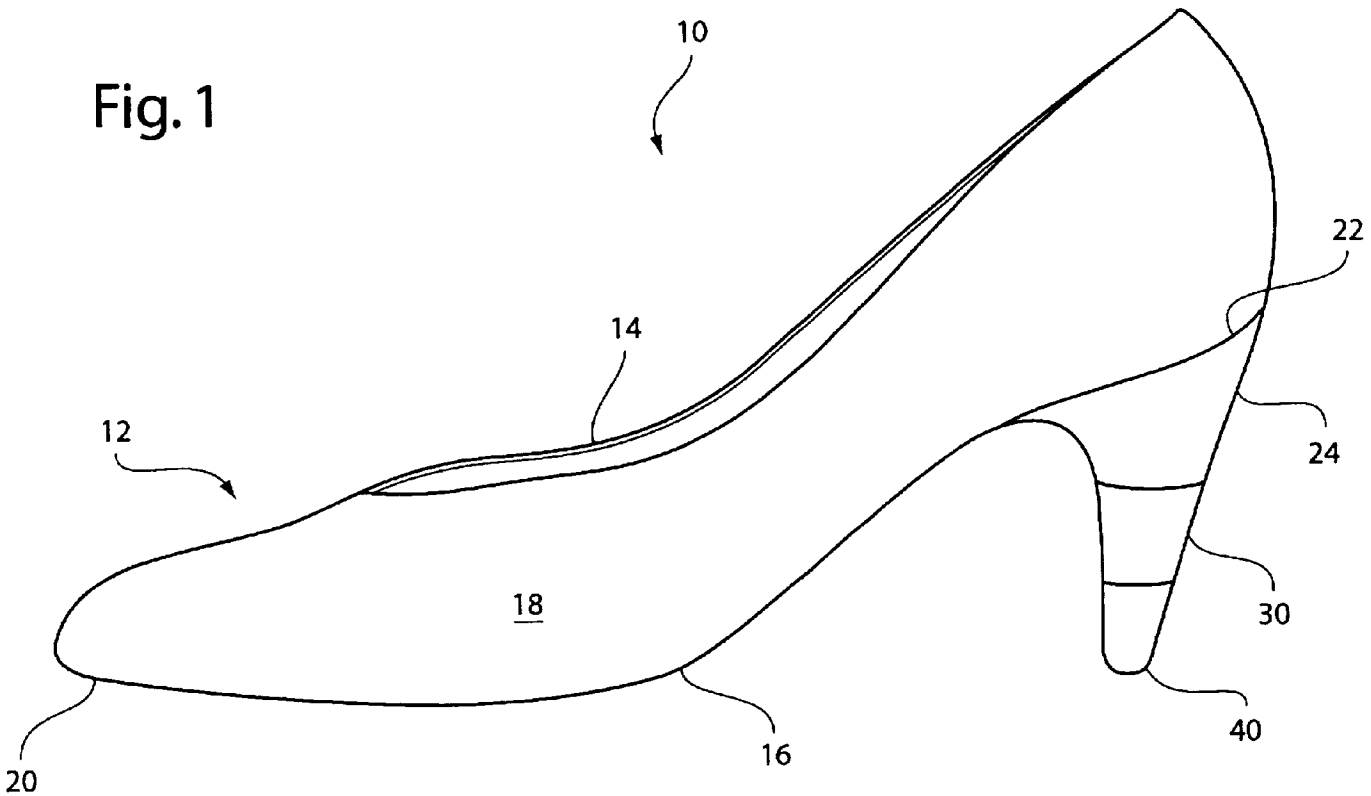
FIG. 1 is a perspective view of the preferred embodiment of the height adjustable flexible shoe constructed in accordance with the principles of the present invention.
Figure 2:
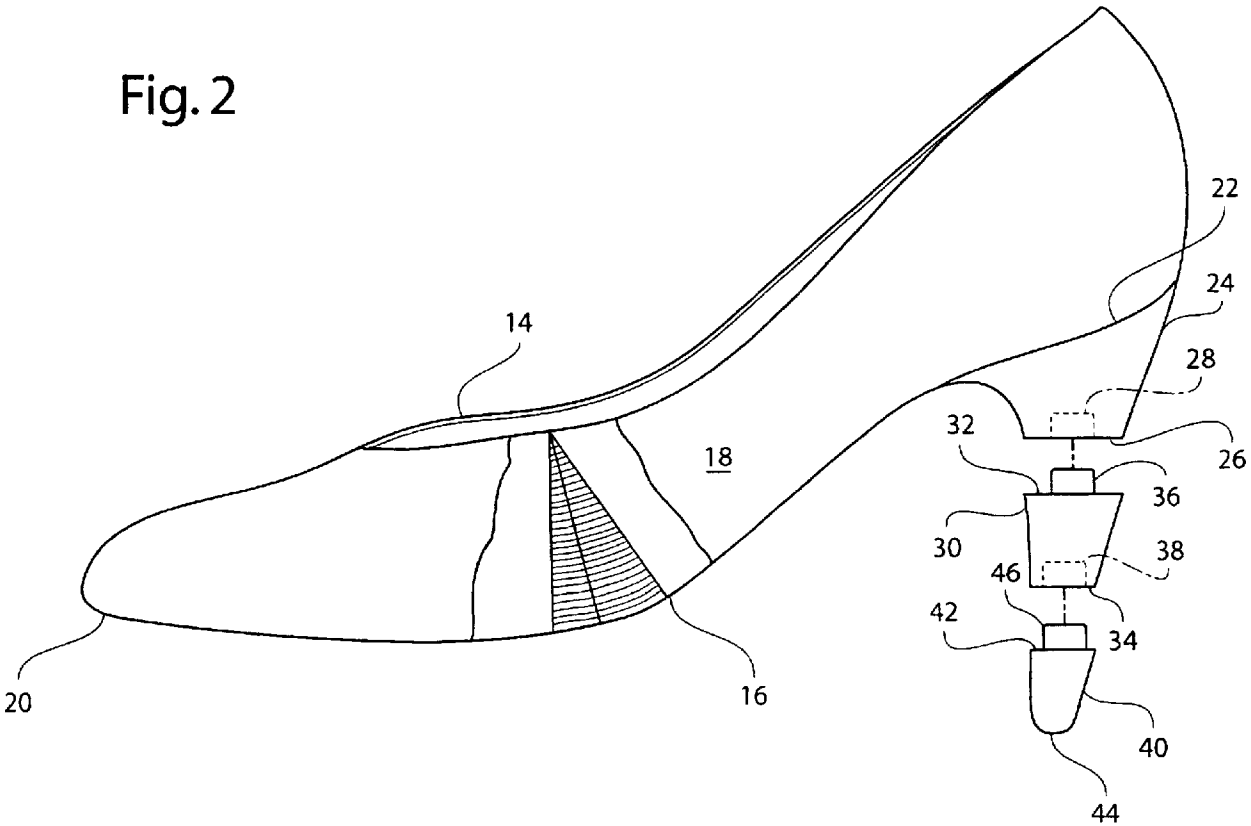
FIG. 2 is an exploded side view of the present invention.

The shoe upper portion 12 has an open upper end 14, a closed lower end 16, and a body portion 18 therebetween. The open upper end 14 is dimensioned for receiving a foot therein. The closed lower end 16 has a toe portion 20 and a back portion 22. The toe portion 20 has a lower surface which extends substantially horizontally, so that it can rest upon a horizontal surface. As with conventional heeled shoe shapes, the back portion 22 is inclined with respect to the toe portion 20. The back portion 22 has a first heel portion 24 extending downwardly therefrom, which accounts for a portion of the heel assembly. The first heel portion 24 has a substantially flat and horizontal lower end 26 with an aperture 28 centered and extending upward therein. The body portion 18 comprises an adjustable elastomeric material which helps the body portion 18 adjust to maintain a comfortable position for the foot at considerably different inclination angles that are dictated by the heel assembly as described hereinafter. Note FIG. 2.

The second heel portion 30 is adapted for selectively and removably coupling with the first heel portion 24 of the shoe upper portion 12. Accordingly, the second heel portion 30 has a wide upper end 32 and a narrow lower end 34. Both the upper end 32 and lower end 34 are substantially flat, parallel to each other, and extend substantially horizontally in use. The wide upper end 32 has a protrusion 36 centered and extending upwardly therefrom. The protrusion 36 is dimensioned and configured for snap engaging the aperture 28 in the lower end 26 of the first heel portion 24 of the shoe upper portion 12 so that the upper end 32 of the second heel portion 30 can extend flush against the lower end 26 of the first heel portion 24. The narrow lower end 34 has an aperture 38 centered and extending upward therein.

The third heel portion 40 is adapted for selectively and removably coupling with the second heel portion 30. The third heel portion 40 has a wide upper end 42 and a narrow lower end 44. Both the upper end 42 and lower end 44 are substantially flat, parallel to each other, and extend substantially horizontally in use. The wide upper end 42 has a protrusion 46 centered and extending upwardly therefrom. The protrusion 46 is dimensioned and configured for being selectively snap engaged with either the aperture 28 of the first heel portion 24 or the aperture 38 the second heel portion 30, so that the wide upper end 42 of the hird heel portion 40 can extend flush against either the lower end 26 of the first heel portion 24, or for increased height: aginst the lower end 44 of the second heel portion 40.

In use, the person wearing the present invention can adjust the height of the device 10 by removing the second and third heel portions 30,40. When all three of the heel portions 24,30,40 are in place, the present invention resembles a high-heel shoe. When all three heel portions 24, 30, and 40 are mounted together, the first heel portion, second heel portion, and third heel portion are all substantially the same in height, wherein the first heel lower end, the second heel upper and lower ends, and the third heel upper end all extend substantially parallel to each other. The heel portions 24, 30, and 40 are all substantially the same in height. Accordingly, each of said heel portions 24, 30, and 40 accounts for one third of the overall "heel height", and removal of one of the second or third heel portions 30 and 40 will reduce the incline angle of the shoe by substantially one third. Clearly then, incremental removal of the third heel portion 40 and the second heel portion 30 will lower the height and inclination angle of the present invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A height adjustable flexible shoe for allowing a person to easily adjust a heel of a shoe to reach a proper height comprising, in combination:

a shoe upper portion having an open upper end, a closed lower end, and a body portion therebetween, the open upper end being dimensioned for receiving a foot therein, the closed lower end having a toe portion and a back portion inclined from the toe portion, the toe portion having a substantially horizontal lower surface, the back portion having a first heel portion extending downwardly therefrom, the first heel portion having a substantially flat and horizontal lower end with an aperture centered and extending upward therein, the body portion being comprised of an adjustable elastomeric material;

a second heel portion adapted for removably coupling with the first heel portion of the shoe upper portion, the second heel portion having substantially flat and parallel wide upper end and narrow lower ends, the wide upper end having a pin protrusion extending upwardly therefrom, the protrusion being dimensioned for snap engaging the aperture in the lower end of the first heel portion of the shoe upper portion, the narrow lower end having an aperture centered and extending upward therein; and a third heel portion adapted for removably coupling with the second heel portion, the third heel portion having a substantially flat wide upper end and a narrow lower end, the wide upper end having a protrusion extending upwardly thereof, the protrusion being dimensioned for being selectively snap engaged with the aperture of the first heel portion and the second heel portion.

2. The height adjustable flexible shoe as recited in claim 1, wherein the first heel portion, second heel portion, and third heel portion are all substantially the same in height, wherein the first heel lower end, the second heel upper and lower ends, and the third heel upper end all extend substantially parallel to each other and horizontal when mated together.

* * * * *